United States Patent [19]

Gilberto

[11] 3,981,377

[45] Sept. 21, 1976

[54] EXHAUST MUFFLER FOR PNEUMATIC TOOL OR MACHINE

[75] Inventor: Paul Gilberto, Milford, Conn.

[73] Assignee: USM Corporation, Boston, Mass.

[22] Filed: Sept. 23, 1975

[21] Appl. No.: 615,907

[52] U.S. Cl. ..... 181/36 A; 181/64 B
[51] Int. Cl.[2] ..... F01N 1/20
[58] Field of Search ..... 181/36A, 45, 64 B

[56] References Cited

UNITED STATES PATENTS

| | | | |
|---|---|---|---|
| 837,347 | 12/1906 | Smith | 181/36 A |
| 2,419,664 | 4/1947 | Tabbert | 181/64 B |
| 2,884,901 | 5/1959 | Chandler et al. | 181/36 A |
| 3,254,522 | 6/1966 | Elliott et al. | 72/391 |
| 3,330,378 | 7/1967 | Waldron | 181/36 A |
| 3,635,605 | 1/1972 | Hall et al. | 417/315 |
| 3,675,732 | 7/1972 | Rosen et al. | 181/36 A |

*Primary Examiner*—Lawrence R. Franklin
*Attorney, Agent, or Firm*—Richard B. Megley; Vincent A. White; Carl E. Johnson

[57] ABSTRACT

An exhaust passageway is provided with a sound muffler comprising an orifice, and means operable against a spring in response to sudden increase of fluid exhaust pressure for relatively restricting the orifice thus to abate the sound of exhausting high pressure gas flow. As the gas pressure to be relieved diminishes in a first stage, the spring automatically enlarges the orifice, in effect, whereby the second stage exhausting is rapidly completed at unobjectionable noise level to permit recycling of a pneumatic machine or tool.

5 Claims, 5 Drawing Figures

EXHAUST MUFFLER FOR PNEUMATIC TOOL OR MACHINE

BACKGROUND OF THE INVENTION

This invention relates to exhaust mufflers, and more particularly to the provision of a sound deadening means useful to reduce impulse and exhaust noise of a cyclically operating pneumatic device. Being of simple, lightweight construction, the muffler means is well adapted to be advantageously embodied in numerous different air-operated machines or hand tools for performing a variety of work. By way of example only, the invention is herein shown and described as applied to a riveting tool of the pneumo-hydraulic type disclosed in U.S. Pat. No. 3,254,522 to Elliott et al., but it will be understood usage of the invention is not thus limited.

According to one method of reducing sound level as heretofore practiced a flow restricting means is provided in an exhaust passage. Unfortunately the resulting lower sound level is then attained at the expense of a longer time of exhaust flow and hence slower operation of the pneumatic device before its work cycle can be repeated.

SUMMARY OF THE INVENTION

In view of the foregoing it is a primary object of this invention to provide a compact and economical sound muffler capable of automatic two stage exhausting of the pressure chamber of a device whereby its operating cycle is not unduly extended and yet noise emitted during the first or higher pressure stage is attenuated to an acceptable level.

With this purpose in view, and as herein illustrated, an exhaust passage, for instance that leading from a pressure intensifier chamber of a riveting gun, is fitted with an exhaust muffler assembly comprising a tubular member or guide for a spring therein, and a flow restrictor shiftable against the spring between open and relatively restricted positions in response to pressure change within the chamber. Preferably the arrangement is such that the restrictor is an axially displaceable, ported disc having a diameter less than an internal diameter of one portion of the guide but greater than the internal diameter of a stop shoulder of the guide. The restrictor disc is normally urged by the spring toward the relatively fully open position wherein that disc abuts a shaped retainer secured in an end of the tubular guide. The port of the restrictor disc in relatively open position is closed by the retainer and is of smaller cross-sectional area than the effective cross-sectional area of the passageway between the tubular guide and the peripheries of the retainer and of the restrictor disc. Accordingly, on incurring the first stage of high pressure discharge, the restrictor is caused by the exhaust to yieldingly seat against the stop shoulder and the smaller restrictor orifice is operative with diminished noise level until a diminished gas pressure enables the spring to return the restrictor to the more open position for quicker and quieter exhaust.

BRIEF DESCRIPTION OF THE DRAWINGS

The foregoing and other features of the invention will now be more particularly described in connection with an illustrative embodiment and with reference to the accompanying drawings thereof, in which.

DESCRIPTION OF PREFERRED EMBODIMENT

Figure 1:
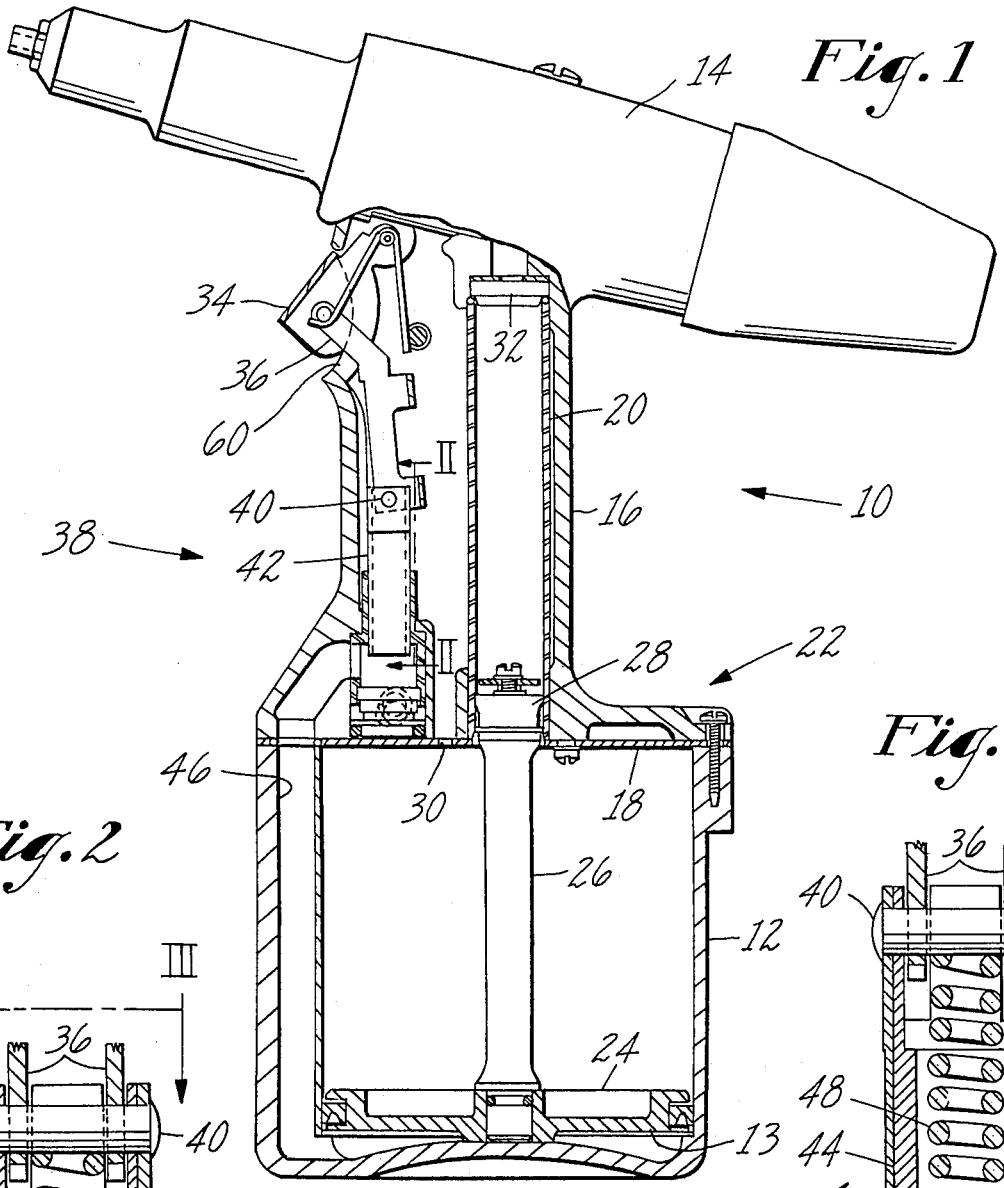
FIG. 1 is a view in side elevation with portions in vertical section of a pneumo-hydraulic riveting tool provided with an exhaust muffler assembly in accordance with the present invention.
Figure 2:
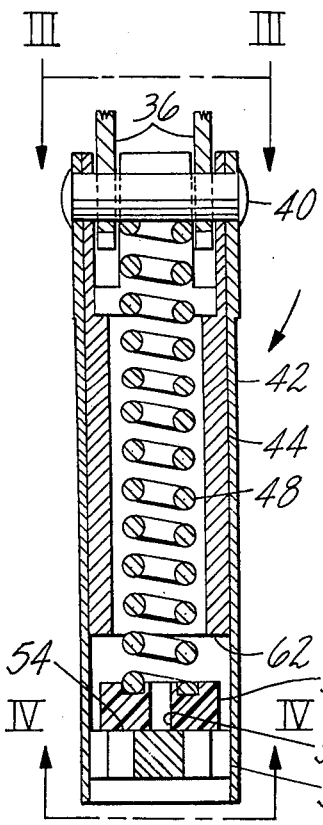
FIG. 2 is a section taken on the line II — II of FIG. 1 and showing the exhaust muffler on a larger scale and in relatively open position.
Figure 3:
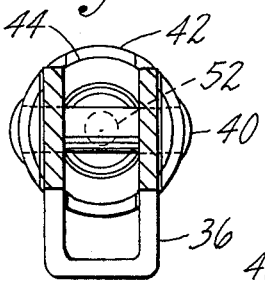
FIG. 3 is a transverse section taken on the line III — III of FIG. 2.
Figure 4:
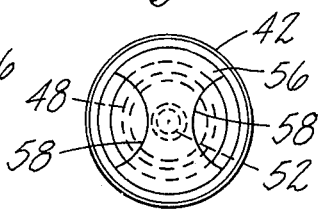
FIG. 4 is a bottom end view of the muffler looking in the direction of the arrows IV — IV of FIG. 3.

Referring to FIG. 1, a rivet setting tool generally designated 10 comprises a pneumatic cylinder 12 for receiving in its annular bottom chamber 13 pressurized air from a source not shown, an upper draw cylinder 14 housing hydraulic rivet pulling means not shown but, for instance, of the general type fully described in the mentioned U.S. Pat. No. 3,254,522, and a hollow handle portion 16 interconnecting the cylinder 14 to an upper end closure 18 of the cylinder 12. It may be assumed for present purposes that the tool 10 is essentially as disclosed in the referenced patent except for novel exhaust muffler means hereinafter to be explained, it being understood that the muffler is not limited in use to riveting devices nor to use in the exhaust system of any particular pneumatic mechanism whether manually operable or otherwise.

By way of background information, the illustrative tool 10 is adapted to set a tubular rivet (not shown) by exerting tension on a mandrel stem until the latter is broken. The considerable force normally required is, in the illustrative tool, derived from a hydraulic supply cylinder 20 (FIG. 1) arranged in the handle 16, and pneumatic booster means 22 to be described for forcing fluid from the fluid supply cylinder 20 to the draw cylinder 14 to effect a working stroke. Though not shown in FIG. 1, the rivet mandrel pulling means may be assumed to be a draw rod having gripping means on one end and an axially reciprocable piston on the other end, the piston being subjected to recoil upon mandrel breakage. As shown in FIG. 1 an air piston seal assembly 24 operable in the cylinder 12 is connected by a rod 26 carrying at its upper end a fluid seal 28 slidable in the hydraulic supply cylinder 20. Air in the cylinder 12 above the piston assembly 24 is vented to the interior of the handle 16 via an aperture 30. It has been found that, especially when a restrictor 32 provides a small channel for flow in the working stroke and relatively large channels for flow in a rapid return stroke, there is often a need for a noise reducing means, as will next be described, to be associated with the exhaust system of the intensifier chamber 13 beneath the air piston seal assembly 24.

A control trigger 34 (FIG. 1) and associated toggle link 36 are actuated to open a valve for pressurizing the intensifier chamber 13 when a mandrel is to be pulled for rivet setting. The lower end of the link 36 is coupled, in the illustrative arrangement, to the upper end of an exhaust muffler assembly 38 (FIGS. 1–5) by means of a pin 40 transversely extending through a tube 42 and one end of an internal tubular spring guide 44 (FIGS. 2–5). The muffler assembly 38 is disposed for communicating with an exhaust passageway 46 (FIG. 1) leading from the pressure chamber 13. In its relatively open condition shown in FIG. 2 the assembly 38 has one end of a compression spring 48 engaging the pin 40, and its other end yieldingly engages an axially shiftable flow restrictor 50 preferably having a central orifice 52, the restrictor then abutting an inner face 54 of a fixed stop or concavo-convex retainer disc 56 secured in an inlet end of the assembly. The arrangement is such that in the relatively open position of the restrictor the orifice 52 is blocked by the face 54 but exhaust air exits from the passageway 46, flows through laterally opposed openings defined by the inner wall of the tube 42 on the one hand and concave walls 58 (FIG. 4) of the disc 56 and the circular periphery of the restrictor 50 on the other hand, and then through the other end of the muffler, to an outlet 60 formed in the handle 16.

Figure 5:
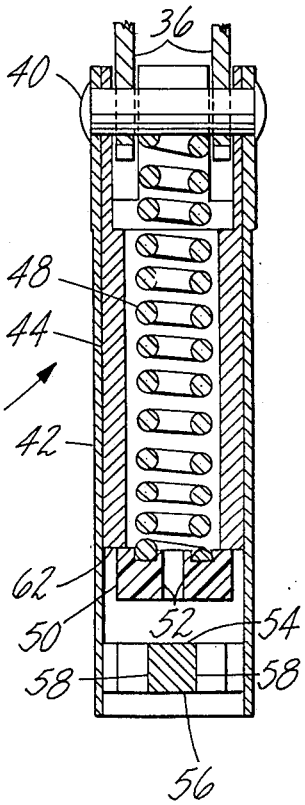
FIG. 5 is a view similar to FIG. 2 but showing the muffler parts in relatively closed or first stage position.

FIG. 5 shows how the restrictor 50 is shifted to a relatively closed or first stage operating position, against resistance of the spring 48, in response to a rapid increase in air pressure in the intensifier chamber 13, as for example when the mandrel is broken by tension exerted by the tool 10. Thus the sudden spurt of exhaust air under pressure causes the restrictor to be axially displaced until it abuts a shoulder or end 62 (FIGS. 2,4) of the spring guide 44, and the air flow is then restricted to the orifice 52 which is of smaller cross-section than afforded by the effective total opening when the muffler was in its relatively open position as above described. This closed position of the restrictor is maintained during exhausting of the high pressure air, and with a reduced sound level, until the compressed spring 48 can overcome the substantially reduced exhaust pressure of the gas flowing from the passageway 46. Then the restrictor is automatically repositioned to the second stage condition shown in FIG. 2 to allow substantially unrestricted flow of the exhaust gas.

From the foregoing it will be apparent that this invention not only attenuates sound levels by providing for exhaust in two stages; it also enables the pneumatically actuated device 10 to function more quietly without increasing to any significant extent the operating time of its cycle. Briefly reviewing this cycle, an operator of the tool had initially depressed the trigger 34 to pressurize the chamber 13 and thereby force the piston assembly 24 to the upper end of the cylinder 12. Pressure in the chamber 13 having caused a buildup of hydraulic pressure in the cylinder 14, the hydraulic pressure and recoil influence at mandrel breaking causes the rod 26 and hence the piston assembly 24 to move toward the bottom of the chamber 13. Resultant high exhaust pressure entering the tube 42 at its lower end displaced the restrictor 50 from relatively open to relatively closed position, i.e. from FIG. 2 condition to that shown in FIG. 5. Compressed air is expelled through the orifice 52 to the expansion chamber provided by the handle 16 to attenuate the sound level of impulse and exhaust noise and escapes to atmosphere via the opening 60. The operator will have released the trigger when the mandrel was broken. When pressure in the chamber 13 has dropped to some intermediate value, dependent on the strength selected for the spring

48, the restrictor 50 will be re-seated against the retainer disc 56, i.e. returned to relatively open position so that air from the chamber 13 can be dumped to atmosphere without incurring objectionable sound.

Having thus described my invention, what I claim as new and desire to secure by Letters Patent of the United States is:

1. An exhaust muffler for a pneumatically actuated device having a pressure chamber and an exhaust passageway for relieving gas pressure in said chamber, the muffler comprising:

an exhaust conduit communicating with said passageway for exhausting said gas pressure from said chamber therethrough;

valve means interposed between said passageway and said conduit having a first state permitting relatively free flow of gas pressure through said conduit and a second state permitting relatively restricted flow of gas pressure through said conduit; and means biasing said valve means for maintaining said valve means in said first state when a relatively low gas pressure is present in said chamber, said biasing means yielding to relatively high gas pressure in said chamber for permitting said valve means to assume said second state.

2. An exhaust muffler as in claim 1 wherein said valve means comprises a tubular housing connecting said conduit with said passageway, stop means between said housing and said conduit, retaining means between said housing and said passageway, said retaining means being fixed to said housing and having at least one relatively large opening permitting gas to freely flow from said passageway into said housing, and restrictor means in said housing responsive to said chamber gas pressure to move from one of said states to the other, said restrictor means being urged by said biasing means to rest upon said retaining means in said first state and thereupon to partially close said opening, whereby gas acting through said opening may freely flow through said partially closed opening at said low pressure but may move said restrictor means against said stop means at a predetermined higher pressure.

3. An exhaust muffler as in claim 2 wherein said stop means is a shoulder having a predetermined diameter, and said restrictor means is a disc having a diameter larger than said predetermined diameter but smaller than the diameter of said tubular housing, said disc further having a restrictive orifice therethrough, whereby when said disc is in said first state, the gas will freely flow therearound and when in said second state, the gas is constrained to flow through said restrictive orifice.

4. An exhaust muffler as in claim 3 wherein said biasing means is a coiled spring having one end fixed in said conduit and the other end abutting said disc.

5. An exhaust muffler as in claim 2 wherein said retaining means is a concavo-convex disc having a center portion which seals said restrictive orifice when said restrictor disc is in said first state.

* * * * *